US005526583A

United States Patent [19]

Hull et al.

[11] Patent Number: 5,526,583

[45] Date of Patent: Jun. 18, 1996

[54] PORTABLE DRY KILN FOR DRYING OR TREATING LUMBER

[76] Inventors: Dwayne E. Hull, Rt. 1 Box 2A, Benedict, Kans. 66714; Joseph B. Sandbothe, 103 N. 3rd. St., Fredonia, Kans. 66736

[21] Appl. No.: 380,301

[22] Filed: Jan. 30, 1995

[51] Int. Cl.[6] ..... F26B 3/00

[52] U.S. Cl. ..... 34/491; 34/191; 34/218; 34/227

[58] Field of Search ..... 34/191, 491, 218, 34/227, 235

[56] References Cited

U.S. PATENT DOCUMENTS

| | | | |
|---|---|---|---|
| 3,131,034 | 4/1964 | Marsh | 34/191 |
| 3,149,932 | 9/1964 | Bachrich | 34/191 |
| 3,630,439 | 12/1971 | Cook | 238/10 R |
| 3,659,352 | 5/1972 | Cook | 34/191 |
| 3,675,600 | 7/1972 | Jones . | |
| 3,714,716 | 2/1973 | Dedrick | 34/30 |
| 4,176,464 | 12/1979 | Randolph | 34/16.5 |
| 4,250,629 | 2/1981 | Lewis | 34/13.8 |
| 4,620,373 | 11/1986 | Laskowski et al. | 34/16.5 |
| 4,922,624 | 5/1990 | Tharpe | 34/29 |
| 5,123,177 | 1/1992 | Koetter et al. | 34/69 |
| 5,138,773 | 8/1992 | Goodwin et al. | 34/13.8 |
| 5,195,251 | 3/1993 | Gyurcsek et al. | 34/191 |
| 5,197,201 | 3/1993 | Salin | 34/191 |
| 5,226,244 | 7/1993 | Carter et al. | 34/191 |
| 5,269,076 | 12/1993 | Breckenridge | 34/15 |
| 5,276,980 | 1/1994 | Carter et al. | 34/191 |

OTHER PUBLICATIONS

Boone, Sidney. *Chpt. 2 Kiln Types and Features.* U.S. Forest Service Dry Kiln Manual.

*Primary Examiner*—John T. Kwon
*Attorney, Agent, or Firm*—Jeffrey L. Streets

[57] ABSTRACT

The present invention provides a portable dry kiln for drying or treating lumber. The kiln can operate with an electrical generator and a gas, oil or waste burning heater to allow use in remote areas. The kiln is small enough to be readily transportable while improving thermal efficiency, humidity control, and eliminating fan motor maintenance problems. A cyclonic circulation of air extending through the kiln chamber is produced by the combined actions of an air supply system and a plurality of fans.

20 Claims, 6 Drawing Sheets

PORTABLE DRY KILN FOR DRYING OR TREATING LUMBER

FIELD OF THE INVENTION

The present invention relates to a method and apparatus for drying or treating lumber using a dry kiln. More particularly, the invention relates to a truly portable dry kiln that operates efficiently and effectively.

BACKGROUND OF THE INVENTION

All woods are divided into two major classes on the basis of the type of tree from which they are cut. Hardwoods are from broad-leaved, deciduous trees. Softwoods are from conifers, which have needle- or scale like leaves, which are, with few exceptions, evergreens. These terms do not refer to the relative hardnesses of the woods in these two classes.

Both hardwood and softwood logs are cut into planks and boards in a saw mill. When rough dimension lumber is cut from a fleshly cut log it may have a moisture content from about 35 to more than about 70 percent water. Before this wood is ready for use it must be seasoned.

Wood is seasoned either by air drying, kiln drying, or a combination of air and kiln drying. Air drying may be considered to give superior quality, but it requires more time, is expensive, and is indefinite. Even lumber that has air dried for a full year may still have a moisture content of about 15 to about 20% or greater. Numerous tests made at the U.S. Forest Service Products Laboratory have failed to show any superiority in air-dried wood when kiln drying was performed properly. Standard schedules for drying wood are published in the U.S. Forest Service Dry Kiln Manual. The drying schedule will vary depending upon the variety of wood, the initial moisture content, and the thickness of the lumber.

These standard drying schedules recognize that the strength of the wood is directly affected by the conditions under which it is dried. More specifically, removing moisture from the wood too quickly can result in cracking or embrittlement of the wood. Drying conditions that are optimal for one variety of wood may cause severe damage to another variety. Therefore, it is important that a dry kiln be capable of accurately creating and controlling wood drying conditions.

Kiln conditions that are most important to the process of drying wood include the air temperature, circulation, and humidity. Accurate control of these conditions minimizes cracks and other defects in the wood while minimizing the time and energy required to dry a batch of lumber.

An exemplary drying schedule for hardwood lumber is that of Red Oak lumber having a thickness between 1 inch and 1.5 inches, obtained from the Dry Kiln Operators Manual, United States Department of Agriculture, Agriculture Handbook No. 188 (August 1991), as set out below:

| Moisture Content (Percent) | Dry Bulb Temp. (°F.) | Wet-Bulb Depression (°F.) | Wet Bulb Temp. (°F.) |
|---|---|---|---|
| >50 | 110 | 4 | 106 |
| 50 | 110 | 5 | 105 |
| 40 | 110 | 8 | 102 |
| 35 | 110 | 14 | 96 |
| 30 | 120 | 30 | 90 |
| 25 | 130 | 40 | 90 |
| 20 | 140 | 50 | 90 |
| 15 | 180 | 50 | 130 |

Most dry kilns currently in use are similar to metal buildings constructed on concrete slabs with heaters, fans, and air-duct systems for delivering warm air to the wood. After the air passes over the wood, it is drawn into an intake vent. The air is then reheated and recirculated back to the delivery vent of the air-duct system. After drying over a period of time, the system is shut down, the kiln is opened, and the wood is sampled. If the water content of the wood is decreasing too rapidly or too slowly, the air temperature and/or air circulation rate can be adjusted. The kiln is resealed, the air is reheated, and the drying process is continued under the adjusted conditions for another period of time. This sequence is repeated until the lumber has been sufficiently seasoned. Each time a kiln is opened, the relatively cool outside air enters the kiln. This is not only a waste of thermal energy and time, but is detrimental to the drying of the wood. It would therefore be desirable to monitor and control the drying of wood lumber without opening the kiln.

Because the air circulation fans, electrical wiring, and electrical connections are housed within the kiln, they are continually exposed to the wet, acidic moisture drawn from the wood. The motors which drive the fans are quick to corrode and require frequent replacement. Aside from the cost of replacing the fan motors, it is inefficient for the kiln to be shut down and opened in order to install a new motor. Because of this arrangement, poor air circulation may go undetected or, if detected, be tolerated for extended periods of time causing uneven drying of the wood. However, replacing the motor immediately means opening up the kiln one more time. It would therefore be desirable to be able to monitor, maintain, and replace fan motors while the kiln remains in operation.

Furthermore, because conventional kilns are large, stationary equipment, lumber must be hauled great distances at significant expense. It is particularly unfortunate that large amounts of diseased or infested forestation can not or should not be transported beyond the boundaries of the affected areas to a kiln without spreading the problem. The result is that the affected trees may be burned on site to prevent the problem from spreading. It would therefore be desirable to have a kiln that could be transported into the affected areas to season the wood. The elevated temperatures of the kiln would kill the bugs or bacteria responsible for the problem so that the seasoned wood could be taken from the area for commercial purposes.

SUMMARY OF THE INVENTION

The present invention provides a kiln for drying or treating lumber, comprising an elongate chamber having first and second ends, a ceiling, a floor, first and second side walls, and a door into the chamber for receiving lumber; a stack region within the chamber adapted to receive a stack of lumber, wherein the stack region has height and width sufficiently less than the height and width of the chamber to allow circulation of air; an air supply system comprising an intake port located near the first end of the chamber, an exhaust port located near the second end of the chamber, and means for moving air into the chamber through the intake port and out of the chamber through the exhaust port; a plurality of circulating fans spaced over the length of the stack region having motive means located outside of the chamber, a shaft coupled to the motive means extending through one of the chamber walls, and fan blades within the chamber coupled to the shaft, the blades directed to cause a substantially transverse circulation of air; adjustable means for directing the substantially transverse circulation of air through the stack region and back to the fans; and a heating element extending substantially the length of the stack region for delivering heat to the air.

The invention also includes a method for drying lumber comprising the steps of placing lumber into a stack region of an elongate chamber having first and second ends; introducing air into the chamber near the first end; heating the air; transversely circulating the air through the stack region, exhausting the air from the chamber near the second end; and removing the lumber from the chamber.

DETAILED DESCRIPTION OF THE PREFERRED EMBODIMENT

The present invention provides a portable dry kiln for drying lumber. The kiln involves a number of systems allow it to be portable while improving thermal efficiency, humidity control, and eliminating certain maintenance problems.

Figure 1:
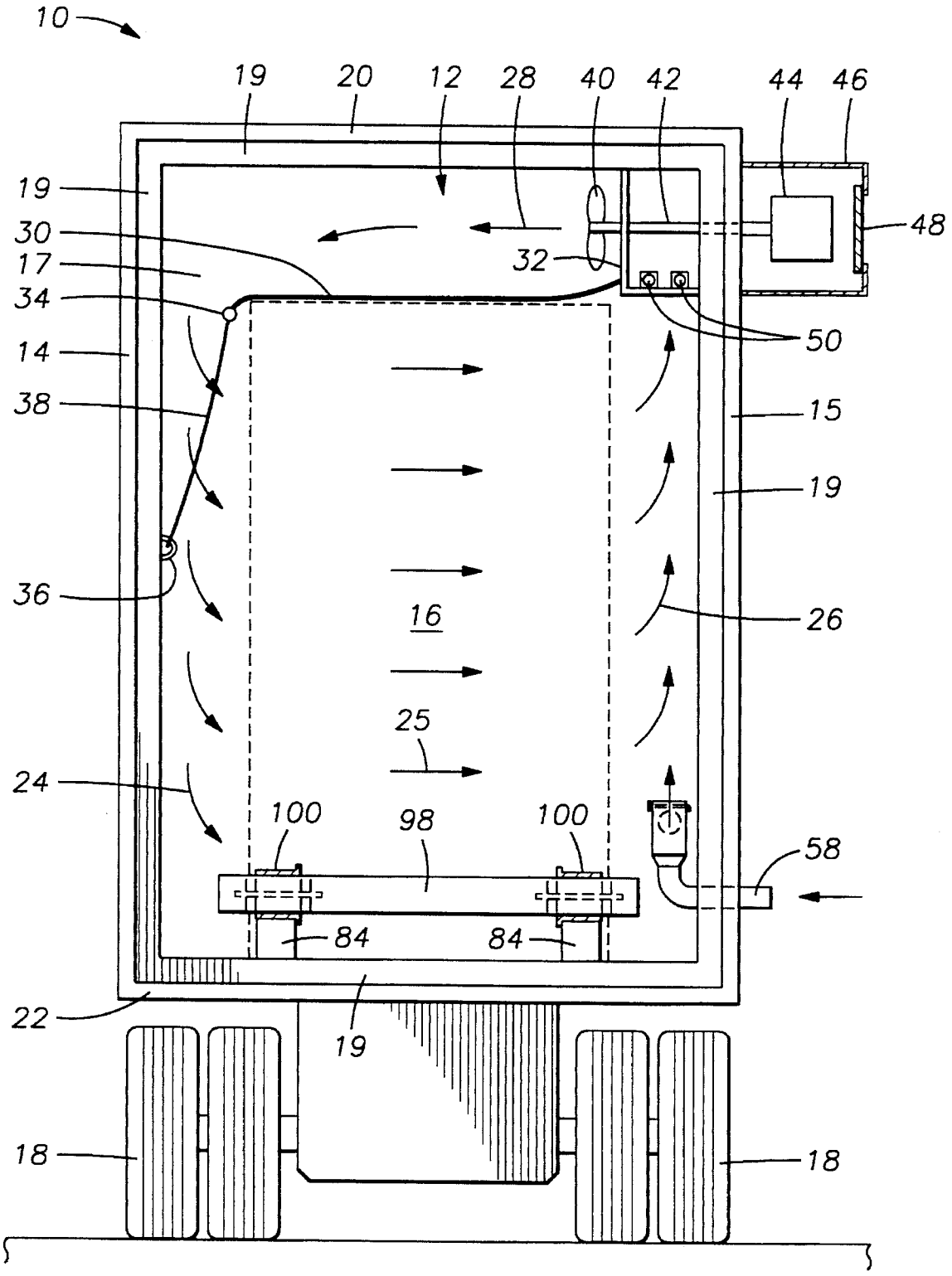
FIG. 1 is an end view of a dry kiln with the rear door removed.

Referring to FIG. 1, a dry kiln 10 is shown having a chamber 12 with insulated walls 14 and 15. The chamber is sufficiently large to allow circulation of air around a stack region 16. While the chamber may be formed of many different materials in many different sizes, the preferred chamber is formed from a standard refrigerated semi tractor trailer having dimensions of approximately 8 feet wide by 10 feet tall by 48 feet long. The kiln 10 of FIG. 1 is shown as part of a semi tractor trailer with a wheel assembly 18. Alternatively, the kiln 10 may have a stationary skid-mounted chamber that can be winched onto a flat semi trailer. In either case, the portable kiln can be prepared for transport in a matter of minutes.

The insulated walls 14 and 15, insulated ceiling 20, insulated floor 22, insulated front wall 17, and insulated back door (not shown) make it easier to control the conditions within the kiln. The preferred conditions will vary according to the wood drying schedule that is to be used for the batch of wood. The drying temperatures in the kiln will typically range between about 100 and about 180 degrees Fahrenheit, but may reach as high as 220 degrees Fahrenheit for particular woods. Insulating the surfaces of the chamber 12 improves the energy efficiency of the kiln as well as the ability to hold a constant temperature throughout the kiln. This is true for year-round operation, but is particularly true in cold weather and climates. While a standard refrigerator semi tractor trailer is insulated to an R value of about 11, it is preferred that additional insulation 19 be added to all internal surfaces of the chamber 12, except perhaps the floor 22. Insulation added to the floor 22 of the chamber 12 should be added to the underneath side of the floor 22. However, it may be advantageous to leave the floor insulation at an R value of 11 so that any condensation occuring within the chamber 12 is on the floor 22 where is can not drip on the wood or seep into the wall insulation. The most preferred chamber will have an overall R-factor of about 30.

The stack region 16 (shown as a dotted line in FIG. 1) is an open space within the chamber 12 which receives stacks of lumber for drying. While the lumber may be stacked in various configurations, the stack will have transverse air passages which allows air to circulate over the top and bottom of each piece of lumber. The stack region 16 has a width that is somewhat less than the width of the chamber 12 so that air may circulation downward along wall 14 (as shown by arrows 24), through the stack region 16 (as shown by arrows 25), and upward along wall 15 (as shown by arrows 26). It is preferred that the stack width be about two (2) feet less than the chamber width, leaving about one foot on each side of the stack for air circulation. The height of the stack region 16 runs from the floor 22 upward towards the ceiling 20, but stops sufficiently below the ceiling to allow good air circulation (as shown by arrows 28). It is preferred that sufficient weight be placed on top of the stack so that the lumber will not warp. It is also preferred that the stack region 16 run the full length of the chamber 12.

While the stack region 16 has certain limitations on its size relative to the chamber, as described above, it is not necessary that the entire region be filled with lumber. In fact, one of the many advantages of the present invention is that the stack width, height, and length can vary widely. When the stack width is narrow there is simply additional space on each side of the stack for the air to flow (as shown by arrows 24 and 26). The kiln 10 also functions properly when the stack length, or total length of several stacks, is less than the length of the chamber 12.

The kiln 10 also accommodates various stack heights by incorporating an adjustable means or flexible barrier 30 for directing the transverse circulation of air (as shown by arrows 28, 24, 25 and 26) through the stack region and back to the fans 40. The barrier 30, typically a canvas-like material, has a first edge attached to a structural member or pole 32 which extends substantially the length of the chamber 12. The barrier 30 has sufficient width that a second weighted edge 34 may extend over the top of a stack despite reasonable variations in the stack size. To assure that the barrier 30 remains in place, it is preferred that the weighted edge 34 be tied to an eyelet 36 in the wall 14 with a rope 38. In this configuration, the barrier 30 directs the circulating air to pass through the stack region 16.

Figure 2:
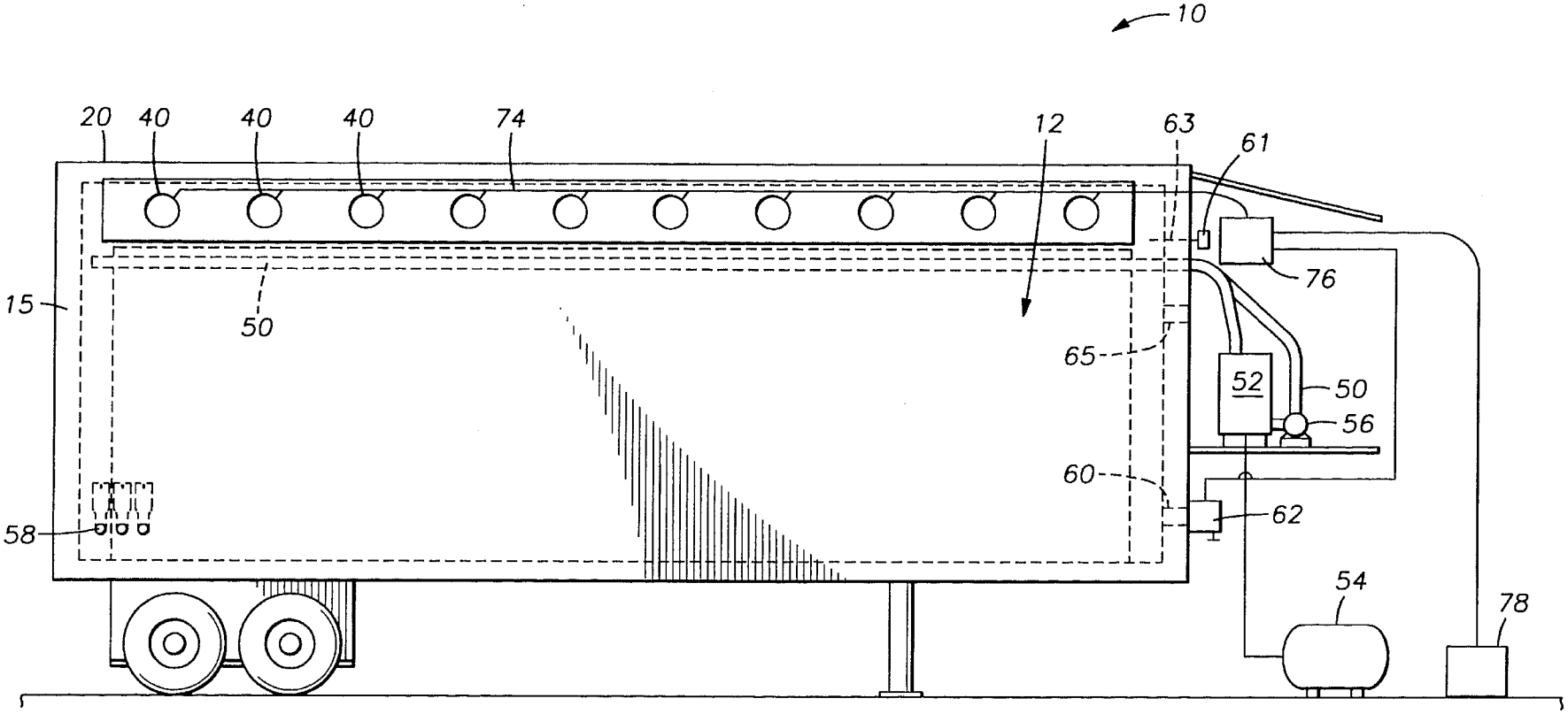
FIG. 2 is a systems diagram for a fully portable dry kiln.

The plurality of fans 40 are positioned to cause transverse circulation of air. Referring briefly to FIG. 2, it is preferred that the fans 40 be positioned just below the ceiling 20 along wall 15. Referring back to FIG. 1, it is most preferred that the fan 40 have a shaft 42 extending through the wall 15 to a motor 44. With the motor 44 installed on the exterior of the chamber 12, the motor 44 and its associated wiring is never exposed to the corrosive or acidic environment found inside the chamber 12 during operation. This arrangement allows the motor 44 to last significantly longer and facilitates maintenance and replacement which may become necessary during operation of the kiln 10. Because the fan motor 44 is on the outside of the chamber 12, a protective housing 46 may be incorporated. A leuvered cover(s) 48, designed to allow circulation of ambient air but prevent entrance of rain, is provided to allow quick access to the motors. In fact, during dry weather the kiln 10 may be routinely operated without the covers 48 in place.

With the fans 40 positioned as shown in FIG. 1, air is circulated as shown by arrows 28, 24, 25, and 26. After the air has passed through the stack region 16 (as shown by arrows 25) and upwards along wall 15 (as shown by arrows 26), it must pass over a heating element 50. The heating element 50 may be any heat transfer device, but it is preferred that the heating element 50 be a heat exchange tube, including residential or commercial fin pipe, having a plurality of fins to maximize heat transfer from the tube to the air. A suitable heat exchange tube for use in the present invention is a householde fin tube made of ¾ inch diameter pipe with 2.375 inch per side square fins spaced about ¼ inch apart. A fin tube of this type is a baseboard element available from Weil-McLain of Michigan City, Ind. under the trademark THERMATRIM.

Referring now to FIG. 2, the heating source may be of any type, but is preferably a heater, boiler, or stove 52 which burns a source of fuel 54 to heat a fluid, such as water or any other heat transfer fluid. Suitable sources of fuel include propane tanks, commercial gas distribution systems, and wastes such as wood, slash (bark, limbs, and the like stripped from a tree to leave only a log), trash, and oil. The heater 52 typically heats the fluid to a temperature between about 200 and about 220 degrees Fahrenheit, as controlled by a thermostat, but may be heated to temperatures exceeding about 220 degrees Fahrenheit, depending upon the applicable wood drying schedule. A makeup tank may be included in the heater 52 to store and automatically makeup for losses of heating fluid. However, where the heating fluid is water, as is generally preferred, the water may be obtained from a commercial water distribution system. The heated fluid is circulated by a pump 56 through the exchange tube 50 which carries the fluid through the chamber 12 before returning the fluid back to the heater 52. Regulation of the air temperature in the kiln is achieved with an extended range thermostat having a thermocouple located within the kiln. When the air temperature falls below a setpoint temperature, the thermostat turns on the fluid transfer pump 56 until the air temperature rises back above the setpoint. When the pump 56 is turned on, the temperature of the heating fluid approaches the temperature of the heater 52. When the pump 56 is turned off, the heating fluid begins to cool off and provides less heating to the chamber. The heating element 50 preferably extends substantially the length of the chamber 12 and has a delivery tube and a return tube.

Where a group of kilns are to be operated in close proximity to each other, it is possible to have a central boiler which provides a reservoir of hot fluid to be individually pumped and delivered to each kiln.

The kiln 10 also includes an air supply system an intake port 58, an exhaust port 60, and means 62 for drawing air through the chamber 12. The intake port 58 allows ambient air to be drawn into the chamber 12. After taking on moisture from the wood, the air is released through the exhaust port 60. Means 62 for drawing air through the chamber 12 is typically a fan. The rate at which air is exhausted can be controlled by varying the fan speed or, preferably, by a slide gate which provides a variable restriction on the air flow. It is important that the exhaust How rate be variable so that the humidity within the chamber 12 can be controlled. When the humidity is too high, the exhaust flow is increased. When the humidity is too low, the exhaust flow is decreased. The humidity in the chamber 12 is measured by a wet-bulb/dry-bulb thermometer 61 having a probe 63 extending into the chamber.

Toward the end of a drying schedule, it is necessary to measure the moisture content of the lumber. The kiln 10 facilitates this measurement with minimal disruption of conditions in the chamber by providing a small quick access door 65 (also shown in FIG. 5), which is typically found in refrigerated semi trailers after the refrigeration unit is removed. The kiln operator can quickly access the lumber, or a smaller piece of lumber intentionally preloaded near the quick access door 65, for measurement. Because the quick access door 65 is no larger than is necessary to reach through and pull out a board, the drying schedule may continue without significant delay. It is preferred that the moisture content of the lumber be measured by electrical resistance of the wood. Moisture content may also be measured by weight, but this method is slower and less reliable.

Figure 3:
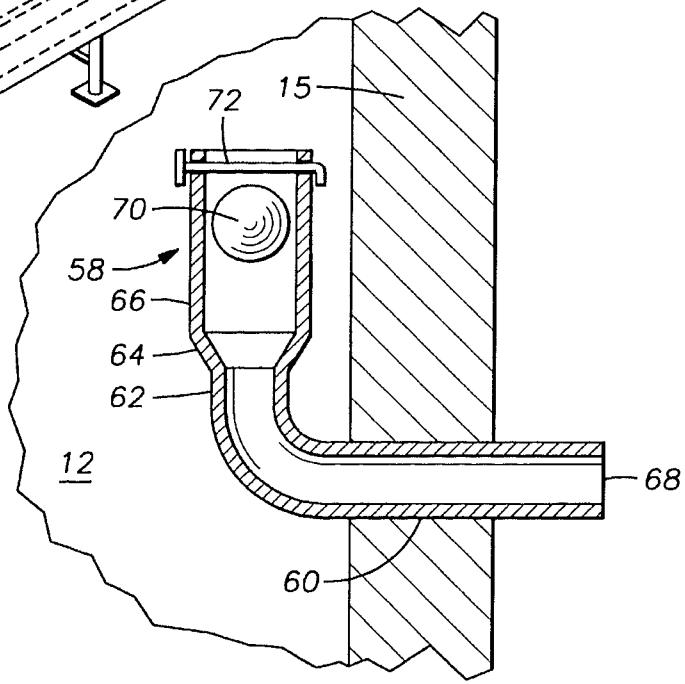
FIG. 3 is a cross-sectional view of an air intake port.

Now referring to FIG. 3, the intake port 58 allows air to pass through a horizontal pipe section 60 and a vertical pipe section 62 to communicate with the chamber 12. The vertical pipe section 62 has an upwardly flaring portion 64 which connects to a pipe section 66 with an increased internal diameter. A lightweight ball 70, such as a pingpong ball, having a diameter greater than the diameter of the vertical pipe section 62, but less than the diameter of the pipe section 66 is positioned within pipe section 66. When the air pressure within the chamber 12 is sufficiently less than the atmospheric pressure outside the chamber at point 68 to raise the ball 70, then air will flow around the ball 70 and enter the chamber 12. The pipe section 66 has a restriction 72 at its terminal end to prevent the ball 70 from being displaced. It is preferred that the restriction be an aluminum pin across the pipe opening and bent downward to secure it in place. It should be recognized the kiln 10 may include a plurality of intake ports 58. Referring back to FIG. 2, the kiln 10 is shown having a plurality of intake ports 58 located together at one end of the chamber 12. It is preferred that kiln 10 has between about 3 and about 15 of the intake ports 58, with about 12 being particularly preferred.

Still referring to FIG. 2, the plurality of fans 40 are spaced along the length of the chamber 12 at substantially equal intervals. It is preferred that a kiln built from a 48 foot refrigeration box have between about 20 and about 25 fans. It is also preferred that a plurality of individual electrical wires 74 deliver electrical current to the individual motors 40 from a fuse box 76. The source of electricity to the fuse box 76 may be either a gas-powered generator 78, for remote use, or an electrical power line (not shown). It is further preferred that the fuse box 76 have separate fuses, indicator lights, and fan on-off switches (not shown) for each individual fan motor 40 as well as the exhaust fan motor(s) 62. In this manner, motor problems will cause the fuse to blow and the indicator light to go out. The kiln operator is then able to switch off the electricity to that specific fan motor, replace the fuse, and turn the fan motor back on. If the fan motor continues to blow fuses, then the fan motor should be turned off for maintenance or replacement. It is preferred that the kiln be equipped with at least two exhaust fans 62 so that problems with an exhaust fan motor do not require the kiln to be shut down or jeopardize the quality of the lumber.

Figure 4:
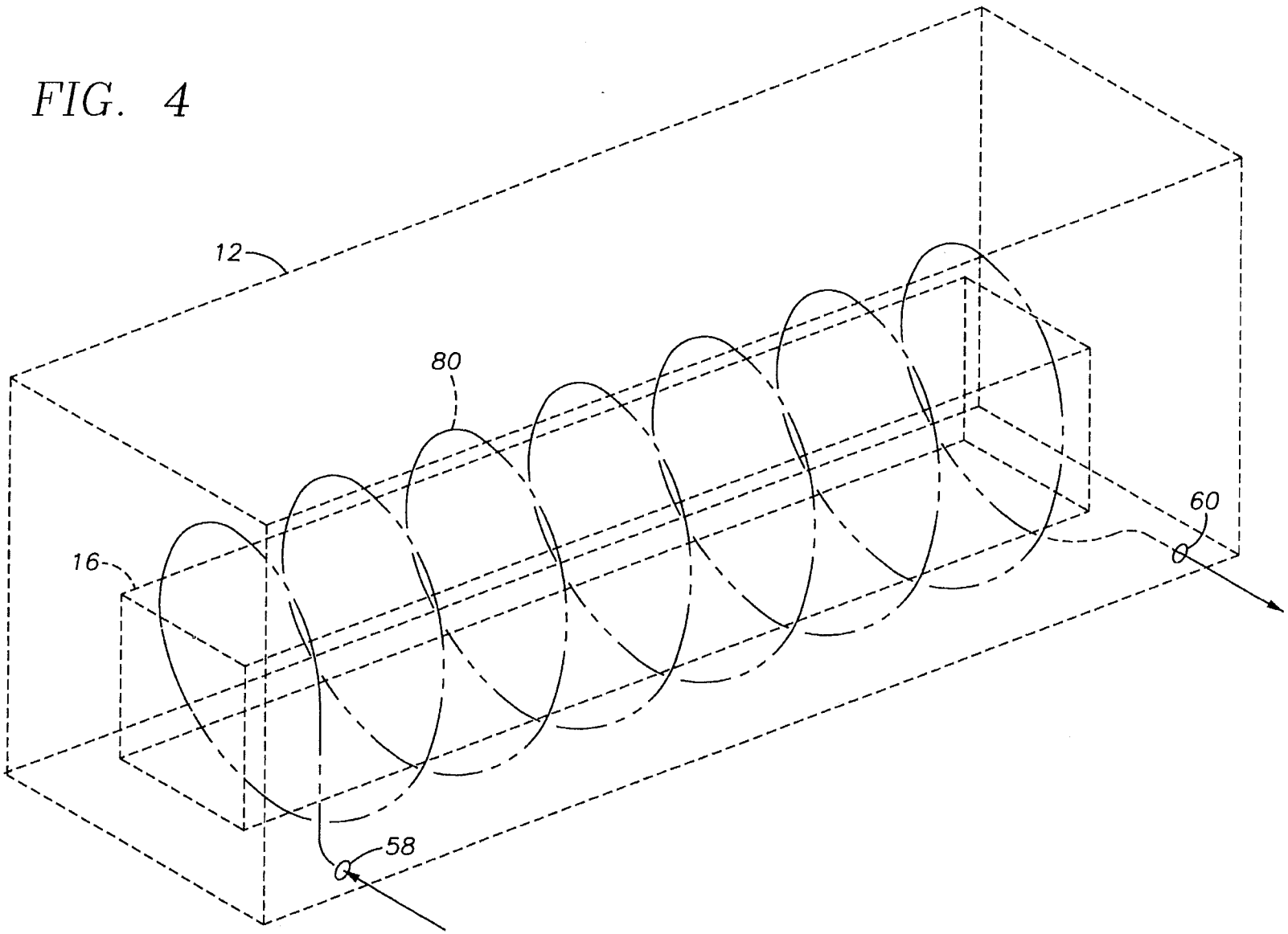
FIG. 4 is a concept diagram showing a dry kiln with cyclonic air circulation passing through the stack region.

Now referring to FIG. 4, the cyclonic air flow provided by the present invention is shown passing from one end of the chamber 12 to the other end. This cyclonic air flow path 80 is the result of the transverse air circulation caused by the plurality of fans 40 (shown by arrows 28, 24, 25, and 26 in FIG. 1) combined with the air caused by the air supply system, specifically the air flow from the intake port 58 to the exhaust port 60 (shown best in FIG. 2). Together, these two flows result in a generally cyclonic flow path which passes through the stack region 16. It should be recognized that the number of cycles that the air makes through the stack region 16 will be determined by both the air circulation rate caused by the fans 40 and the air exhaust rate.

Figure 5:
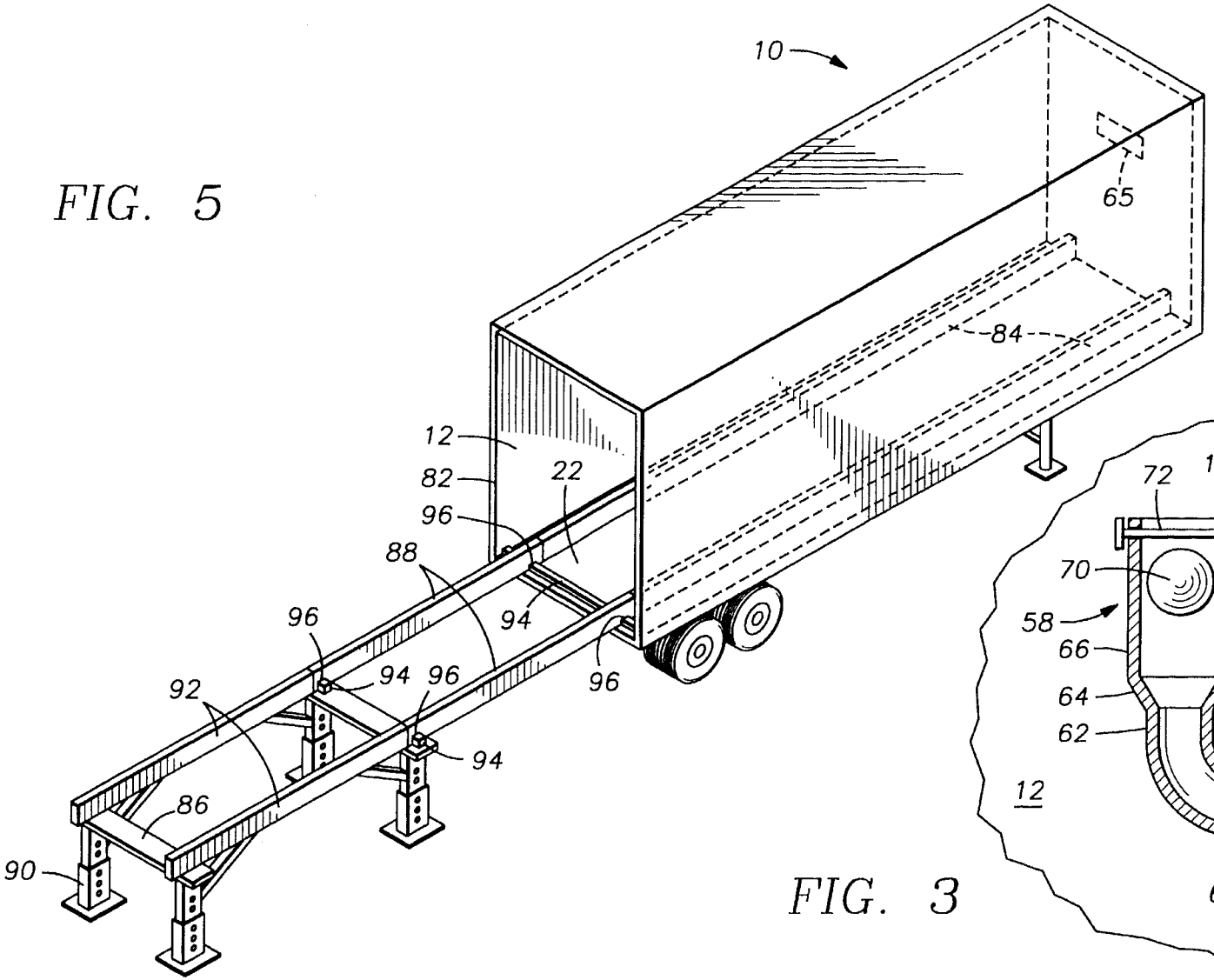
FIG. 5 is a perspective view of a dry kiln rail system.

Now referring to FIG. 5, the kiln 10 is shown having a lumber delivery system or rail system assembled at the rear kiln door 82. The rail system includes a set of internal rails 84, a self-supporting and height-adjustable stand 86, and a set of spanning rails 88. The stand 86 and spanning rails 88 can be stored inside the chamber 12 during transport of the kiln and removed prior to loading the kiln with lumber. The rails are made of a sturdy metal in order to provide a smooth and level surface on which a cart can travel. The self-supporting stand 86 has four legs 90 which adjust upward and downward so that the rails 92 can be aligned with the internal rails 84. Both the stand 86 and the trailer floor have a bar 94 that runs perpendicular to the rails 84, 88 and 92. The spanning rails 88 have a notch 96 on the underneath side of each end which hooks over the top of the bar 94. In this manner, the rail system provides a pair of continuous rails over which a cart can travel.

Figure 7:
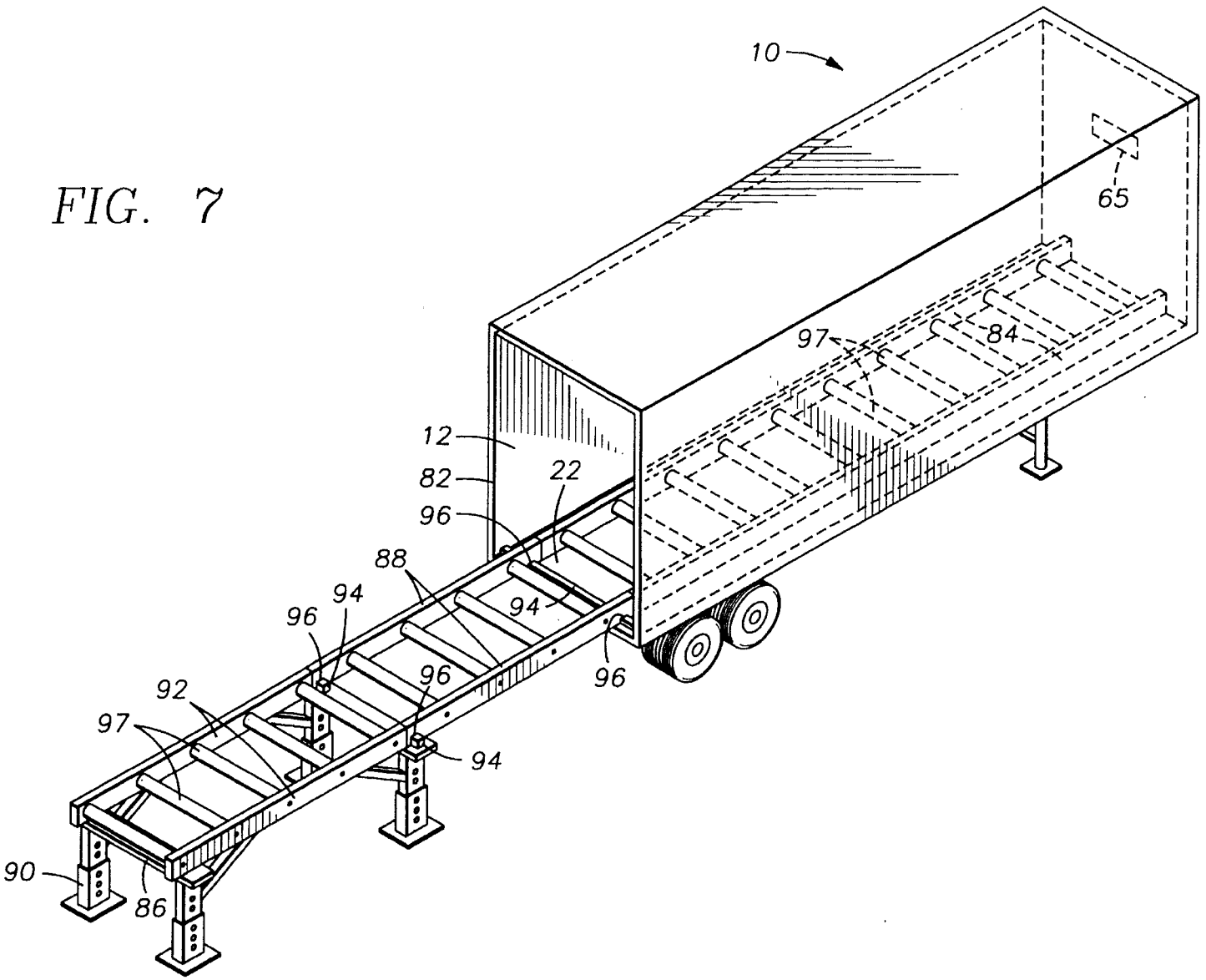
FIG. 7 is a perspective view of a dry kiln roller system.

Alternatively, the delivery system may be a roller system as shown in FIG. 7. A preferred roller system includes rollers having a diameter of between about 3 and about 4 inches spaced about one foot apart over the length of the roller system. Having a roller system with roughly the same dimensions as the rail system described above, including a self-supporting and height-adjustable stand and section of spanning rollers, allows palletized stacks of lumber to be loaded into the kiln.

Referring back to FIG. 1, an end view of a cart 98 having four or more wheels 100 in rolling communication with the rails 84. The cart 98 has a very low profile to conserve kiln space. It is preferred that the cart 98 and rail 84 have a total height of less than one foot. The cart 98 and wheels 100 are preferably made of aluminum to minimize corrosion while maintaining a lightweight and inexpensive cart 98. It is typical that multiple carts are necessary to load several stacks of lumber until the stack region 16 is full.

Referring back to FIG. 5, the rail system may further incorporated various means for drawing the carts 98 into the chamber 12, including rope and pulley configurations, winches, hydraulic systems, chain drives, belt drives, and the like. Once the kiln 10 is loaded, the spanning rails 88 are lifted out of the way and the kiln is sealed up.

Figure 6:
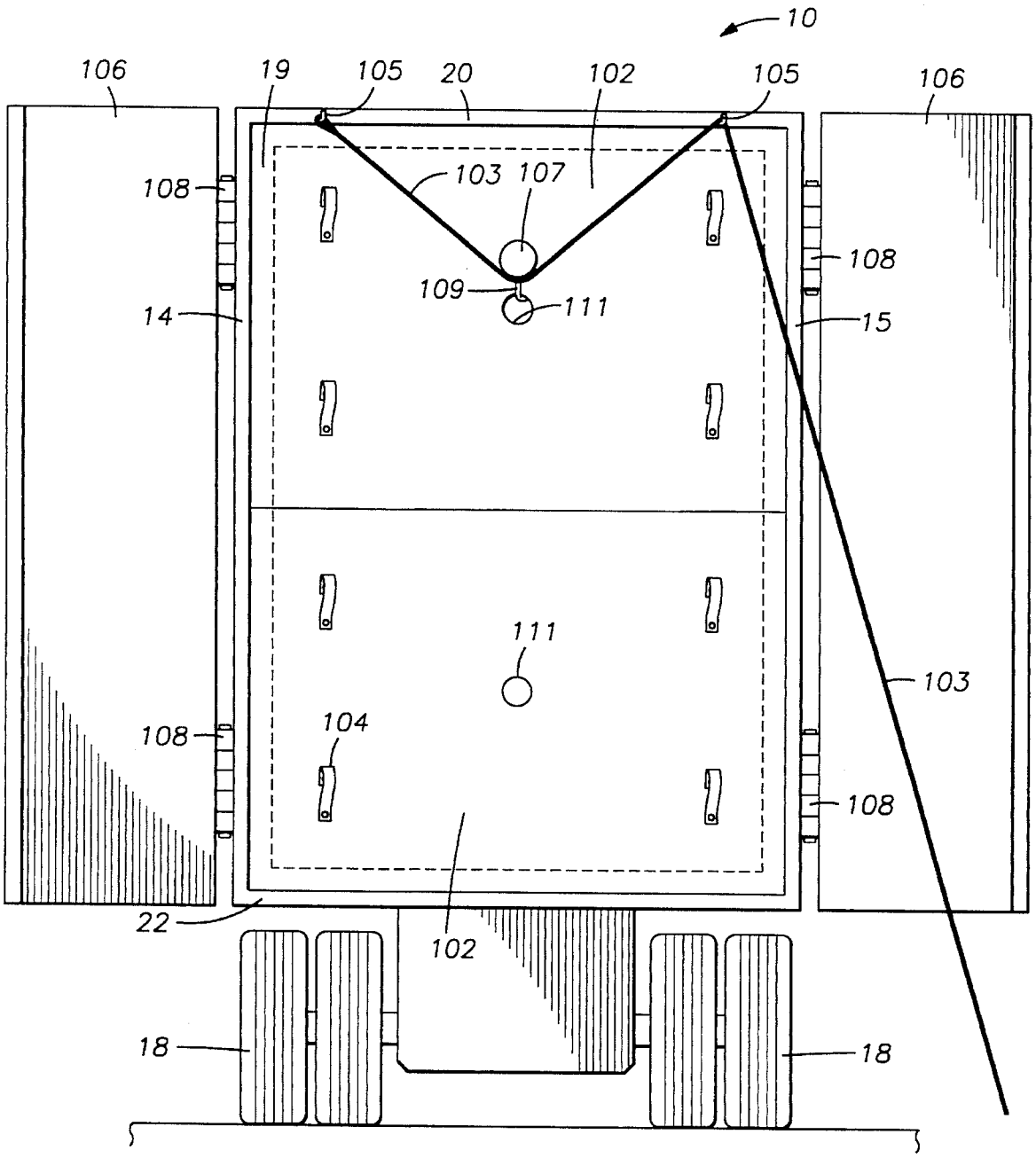
FIG. 6 is an end view of a door assembly for a dry kiln.

Now referring to FIG. 6, a rear view of the kiln 10 is shown having two rectangular insulation panels 102, preferably polystyrene foam sandwiched between two sheets of plywood, positioned inside the opening. It is preferred that the insulation panels 102 form a thermal barrier substantially equivalent to the R value of the chamber walls, which is preferably about R 30. The panels 102 are fit flush against the additional wall insulation 19 which generally protrudes inward from the walls 14 and 15, and ceiling 20. For ease of handling, it is preferred that the panels 102 be fitted with a pulley system and several straps 104 for manually lifting the panels into place. The pulley system may be configured many ways, but the preferred pulley system includes a rope 103, two stationary hooks 105 evenly spaced from the vertical center of panel 102, a pulley 107 having a downwardly extending hook 109, and hook securing means 111 incorporated into each panel 102. It should be recognized that the hook securing means 111 can be formed in many ways, but specifically includes loops, handles, indentations, holes, hooks, and the like. A first end of the rope 103 is passed over a first hook 105 and through the pulley 107 before being attached to a second hook 105. After securing the downwardly extending hook 109 to the hook securing means 111, the second end 113 of the rope 103 is pulled downward to lift the panel 102. Once the panels are securely in place, the pulley system is removed and the trailer doors 106, having hinges 108, are closed and latched (latches not shown).

The present invention also includes a method for drying lumber. The kiln is transported to the location where lumber is to be seasoned or dried. The rail system, heating fuel source and generator are then set up for operation. Lumber is stacked neatly on a cart that can be placed on the rail system by a forklift. It is preferred that a stacking jig be used to achieve a straight and uniform stack. After the stack and cart are on the rail stand, the cart is gently pushed into the kiln. This process is repeated until the kiln is full or all the wood is loaded. The flexible barrier is then lowered over the top of the stack. The kiln is then closed by removing the spanning rails, positioning the insulated panels in the door opening, and closing the doors.

The preferred sequence in starting up the loaded kiln involves turning on the fans 40 to transversely circulate the air through the stack region, turning on the exhaust fan 62 to pull air through the chamber 12, circulating water through the exchange tubes 50 to exchange heat with the air, and turning on the heater 52. At this point, the operator monitors the air temperature and humidity in the kiln and makes adjustments to the water temperature and exhaust flow rate so that the conditions follow the appropriate drying schedule. Near the end of the drying schedule, the moisture content of the lumber is measured by pulling a piece of lumber through the access door 65. Moisture measurements are made periodically until the moisture content in the lumber reaches the desired level. Only then should the operator shut down the kiln and remove the lumber.

It should be recognized that the kiln of the present invention is equally well suited to treat wood as it is to dry wood. In the treating mode, the kiln is held at temperatures that provide only a sufficient level of heat to kill infestations of insects, bacterias, molds, and/or fungus in the wood. After being held at this temperature for a specified period of time, the treated wood can then be transported out of infested timber areas for further manufacturing, drying, or handling. Treating the wood before it is removed from the timber has been shown to minimize the likelihood that the infestation will be spread into healthier forest or timber while maximizing the recovery of this natural resource.

When several different species of wood are to be dried in a single kiln, the drying schedule is fixed by the slowest, most moderate drying schedule of any of the woods. This inefficiency is tolerated by operators with a single, large kiln that need to dry a variety of woods. However, because of the smaller size, reduced cost, improved energy efficiency, and ease of loading and unloading, the present invention makes it possible for the operator to have multiple kilns. For most efficient operation, the woods with the most similar drying schedules should be grouped together and dried in the same kiln.

Therefore, the kiln of the present invention can be used to dry wood, kill infestations of insects, bacterias, molds, and/or fungus, and transport lumber. Operation of the present invention provides the benefits of reduced handling costs, increased wood recovery, improved local or site environmental condition, and improved drying and treating efficiency.

It will be understood that certain combinations and sub combinations of the invention are of utility and may be employed without reference to other features in sub combinations. This is contemplated by and is within the scope of the present invention. As many possible embodiments may be made of this invention without departing from the spirit and scope thereof, it is to be understood that all matters hereinabove set forth or shown in the accompanying drawing are to be interpreted as illustrative and not in a limiting sense.

While the foregoing is directed to the preferred embodiment, the scope thereof is determined by the claims which follow:

What is claimed is:

1. A kiln for drying lumber, comprising:

a. an elongate chamber having first and second ends, a ceiling, a floor, first and second side walls, and a door into the chamber for receiving lumber;

b. a stack region within the chamber adapted to receive a stack of lumber, wherein the stack region has height and width sufficiently less than the height and width of the chamber to allow circulation of air;

c. an air supply system comprising an air intake port directly communicating with only the first end of the chamber, an air exhaust port directly communicating with only the second end of the chamber, and means for drawing air out of the chamber through the exhaust port;

d. a plurality of circulating fans spaced over the length of the stack region having motive means, electrical wiring and electrical connections located outside of the chamber, a shaft coupled to the motive means sealably extending through one of the chamber walls, and fan blades within the chamber coupled to the shaft, wherein the fan blades are directed substantially transverse of the elongate chamber, wherein air flows through the chamber in a substantially helical circulation pattern from the first end to the second end;

e. adjustable means for directing the substantially helical circulation of air through the stack region and back to the fans; and f. a heating element extending substantially the length of the stack region for delivering heat to the air.

2. The kiln of claim 1 wherein the chamber is insulated to an R value of between about 11 and about 30.

3. The kiln of claim 1 wherein the kiln is portable.

4. The kiln of claim 3 wherein the chamber is adapted to be mounted on a trailer.

5. The kiln of claim 1 wherein each circulating fan has separate motive means comprising an electric motor.

6. The kiln of claim 4 wherein each circulating fan has a separate electric fan motor and wherein the kiln further comprises a portable electrical generator for supplying power to the fan motors.

7. The kiln of claim 1 wherein the heating element is a heat exchange tube having a plurality of fins.

8. The kiln of claim 7 wherein the heat exchange tube is adapted to receive a supply of heated fluid.

9. The kiln of claim 8 further comprising:

g. a boiler in fluid communication with the heat exchange tube for producing the heated fluid; and h. a fuel tank supplying fuel to the boiler for burning,

10. The kiln of claim 3 further comprising a lumber delivery system for loading pre-stacked lumber through the chamber door having a pair of internal rails extending through the stack region, an external rail support stand having legs with adjustable height and a pair of external rails, a pair of detachable spanning rails having a first end in aligned communication with the pair of internal rails and a second end in aligned communication with the pair of external rails, and a cart having wheels in guided communication with the rails.

11. The kiln of claim 3 further comprising a lumber delivery system for loading pre-stacked lumber through the chamber door having a pair of internal rails extending through the stack region, an external rail support stand having legs with adjustable height and a pair of external rails, a pair of detachable spanning rails having a first end in aligned communication with the pair of internal rails and a second end in aligned communication with the pair of external rails, and wherein a plurality of rollers extend between the rails at spaced intervals.

12. The kiln of claim 1 wherein the air supply system further comprises means for controlling the rate of air flow out of the chamber.

13. The kiln of claim 1 further comprising a quick access door for periodically accessing samples of the lumber.

14. The kiln of claim 1 further comprising means for measuring the humidity of the air near the second end of the chamber.

15. The kiln of claim 1 wherein the air supply system and the plurality of fans work in cooperation to cause a substantially cyclonic air flow through the chamber.

16. The kiln of claim 1 wherein the adjustable means is a flexible barrier having a first edge positioned immediately adjacent the plurality of fans, sufficient width to allow a second edge to extend over the stack region, and length substantially equal to the length of the chamber.

17. A method for drying lumber comprising the steps of:

a. placing lumber into a stack region of an elongate chamber having first and second ends;

b. introducing air into the chamber near the first end;

c. heating the air to a select temperature;

d. circulating the air through the stack region with a plurality of fans having individual motors, e. monitoring the operation of the plurality of individual fan motors;

f. exhausting the air from the chamber near the second end, wherein the overall air flow through the chamber is substantially helical.

18. The method of claim 17 further comprising the steps of:

g. monitoring the humidity of the air in the chamber; and h. controlling the flow rate of air being exhausted from the chamber to adjust the humidity.

19. The method of claim 18 further comprising the steps of:

i. obtaining a piece of lumber from the chamber through a quick access door;

j. testing the moisture content in the lumber; and k. repeating steps b through j until the moisture content in the lumber is at a desired level.

20. The method of claim 17 further comprising the steps of:

g. transporting the chamber to a remote location.

* * * * *